US010847110B2

(12) United States Patent
Lee et al.

(10) Patent No.: US 10,847,110 B2
(45) Date of Patent: Nov. 24, 2020

(54) DISPLAY DEVICE AND METHOD OF DRIVING THE SAME

(71) Applicant: Samsung Display Co., Ltd., Gyeonggi-Do (KR)

(72) Inventors: Seung-Hee Lee, Hwaseong-si (KR); Hyo-Chul Lee, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/380,388

(22) Filed: Apr. 10, 2019

(65) Prior Publication Data

US 2019/0378471 A1 Dec. 12, 2019

(30) Foreign Application Priority Data

Jun. 12, 2018 (KR) ..... 10-2018-0067135

(51) Int. Cl.
*G09G 3/36* (2006.01)

(52) U.S. Cl.
CPC ..... *G09G 3/3688* (2013.01); *G09G 3/3696* (2013.01); *G09G 2310/027* (2013.01); *G09G 2310/08* (2013.01); *G09G 2320/0276* (2013.01); *G09G 2320/0673* (2013.01)

(58) Field of Classification Search
CPC combination set(s) only.
See application file for complete search history.

(56) References Cited

U.S. PATENT DOCUMENTS

2014/0022232 A1* 1/2014 Uehata ..... G09G 3/3614 345/212

FOREIGN PATENT DOCUMENTS

| | | | |
|---|---|---|---|
| JP | 201741867 | A | 2/2017 |
| KR | 100590747 | B1 | 6/2006 |
| KR | 1020070067968 | A | 6/2007 |
| KR | 1020150076442 | A | 7/2015 |
| KR | 1020180007038 | A | 1/2018 |

* cited by examiner

*Primary Examiner* — Deeprose Subedi
(74) *Attorney, Agent, or Firm* — Cantor Colburn LLP

(57) ABSTRACT

A display device includes a display panel including a data line and a unit pixel including sub pixels having different colors from each other, where the sub pixels of the unit pixel are connected to a same data line, an image data analyzer which determines whether image data of a horizontal line satisfies a condition of a charging inferiority pattern, and an output buffering part including a first amplifier which amplifies and outputs a data voltage of a positive polarity and a second amplifier which amplifies and outputs a data voltage of a negative polarity, where a low power voltage terminal of the first amplifier and a high power voltage terminal of the second amplifier receive power voltages having different levels from each other, respectively, when the image data of the horizontal line satisfies the condition of the charging inferiority pattern.

20 Claims, 10 Drawing Sheets

DISPLAY DEVICE AND METHOD OF DRIVING THE SAME

This application claims priority to Korean Patent Application No. 10-2018-0067135, filed on Jun. 12, 2018, and all the benefits accruing therefrom under 35 U.S.C. § 119, the content of which in its entirety is herein incorporated by reference.

BACKGROUND

1. Field

Exemplary embodiments of the invention relate to a display device and a method of driving the display device. More particularly, exemplary embodiments of the invention relate to a display device with improved display quality and a method of driving the display device.

2. Description of the Related Art

Generally, a liquid crystal display ("LCD") includes a thin film transistor ("TFT") substrate, a counter substrate and a liquid crystal ("LC") layer between the TFT substrate and the counter substrate.

The LCD may include a plurality of the pixels. Each of the pixels may include a switching element connected to a data line and a gate line, an LC capacitor connected to the switching element and a storage capacitor connected to the LC capacitor.

The LCD may display an image using a positive data voltage and a negative data voltage with respect to a common voltage applied to the LC capacitor and the storage capacitor.

BRIEF SUMMARY

Exemplary embodiments of the invention provide a display device with improved display quality.

Exemplary embodiments of the invention provide a method of driving the display device.

According to an exemplary embodiment of the invention, a display device includes a display panel including a data line and a unit pixel including sub pixels having different colors form each other, where the sub pixels of the unit pixel are connected to a same data line, an image data analyzer which determines whether image data of a horizontal line satisfies a condition of a charging inferiority pattern, and an output buffering part including a first amplifier which amplifies and outputs a data voltage of a positive polarity and a second amplifier which amplifies and outputs a data voltage of a negative polarity, where a low power voltage terminal of the first amplifier and a high power voltage terminal of the second amplifier receive power voltages having different levels from each other, respectively, when the image data of the horizontal line satisfies the condition of the charging inferiority pattern.

In an exemplary embodiment, a high power voltage terminal of the first amplifier may receive an analog power voltage, and a low power voltage terminal of the second amplifier may receive a ground voltage.

In an exemplary embodiment, a low power voltage terminal of the first amplifier may receive a positive polarity half power voltage which is lower than a half power voltage having a half level of the analog power voltage, and the high power voltage terminal of the second amplifier may receive a negative polarity half power voltage which is higher than the half power voltage.

In an exemplary embodiment, the display device may further include a charging compensator which generating generates a compensation data voltage for compensating a charging ratio of a data voltage corresponding to the image data of the horizontal line, when the image data of the horizontal line satisfies the condition of the charging inferiority pattern.

In an exemplary embodiment, the compensation data voltage may include an over-driving data voltage having a level higher than the data voltage corresponding to the image data of the horizontal line and an under-driving data voltage having a level lower than the data voltage corresponding to the image data of the horizontal line.

In an exemplary embodiment, when image data of a pervious horizontal line of the horizontal line are equal to or greater than a first reference value and the image data of the horizontal line are equal to or less than a second reference value, the data voltage corresponding to the image data of the horizontal line may be compensated based on the under-driving data voltage. In such an embodiment, when image data of the pervious horizontal line of the horizontal line are equal to or less than the second reference value and the image data of the horizontal line are equal to or greater than the first reference value, the data voltage corresponding to the image data of the horizontal line may be compensated based on the over-driving data voltage.

In an exemplary embodiment, the compensation data voltage may be applied to the first amplifier or the second amplifier.

In an exemplary embodiment, when the image data of the horizontal line does not satisfy the charging inferiority pattern, the low power voltage terminal of the first amplifier and the high power voltage terminal of the second amplifier may receive power voltages of a same level, respectively.

In an exemplary embodiment, the low power voltage terminal of the first amplifier and the high power voltage terminal of the second amplifier may receive a half power voltage having a half level of an analog power voltage, the high power voltage terminal of the first amplifier may receive an analog power voltage, and the low power voltage terminal of the second amplifier may receive the ground voltage.

In an exemplary embodiment, the display device may further include a digital-to-analog convertor which converts the image data of the horizontal line to the data voltage corresponding to the image data of the horizontal line using a gamma voltage, where the data voltage corresponding to the image data of the horizontal line is applied to an input terminal of the first amplifier or an input terminal of the second amplifier.

According to an exemplary embodiment of the invention, a method of driving a display device which includes a data line and a unit pixel including sub pixels having different colors from each other and connected to a same data line, respectively, includes determining whether image data of a horizontal line satisfies a condition of a charging inferiority pattern, amplifying and outputting a data voltage of a positive polarity through a first amplifier, amplifying and outputting a data voltage of a negative polarity through a second amplifier and applying power voltages having different levels from each other to a low power voltage terminal of the first amplifier and a high power voltage terminal of the second amplifier, respectively when the image data of the horizontal line satisfies the condition of the charging inferiority pattern.

In an exemplary embodiment, the method may further include applying an analog power voltage to a high power voltage terminal of the first amplifier and applying a ground voltage to a low power voltage terminal of the second amplifier.

In an exemplary embodiment, a low power voltage terminal of the first amplifier may receive a positive polarity half power voltage which is lower than a half power voltage having a half level of the analog power voltage, and the high power voltage terminal of the second amplifier may receive a negative polarity half power voltage which is higher than the half power voltage.

In an exemplary embodiment, the method may further include generating a compensation data voltage for compensating a charging ratio of a data voltage corresponding to the image data of the horizontal line, when the image data of the horizontal line satisfies the condition of the charging inferiority pattern.

In an exemplary embodiment, the compensation data voltage may includes an over-driving data voltage having a level higher than the data voltage corresponding to the image data of the horizontal line and an under-driving data voltage having a level lower than the data voltage corresponding to the image data of the horizontal line.

In an exemplary embodiment, when image data of a pervious horizontal line of the horizontal line are equal to or greater than a first reference value and the image data of the horizontal line are equal to or less than a second reference value, the data voltage corresponding to the image data of the horizontal line may be compensated based on the under-driving data voltage. In such an embodiment, when the image data of the pervious horizontal line are equal to or less than the second reference value and the image data of the horizontal line are equal to or greater than the first reference value, the data voltage corresponding to the image data of the horizontal line may be compensated based on the over-driving data voltage.

In an exemplary embodiment, the compensation data voltage may be applied to the first amplifier or the second amplifier.

In an exemplary embodiment, when the image data of the horizontal line does not satisfy the charging inferiority pattern, the low power voltage terminal of the first amplifier and the high power voltage terminal of the second amplifier may receive power voltages of a same level, respectively.

In an exemplary embodiment, the low power voltage terminal of the first amplifier and the high power voltage terminal of the second amplifier may receive a half power voltage having a half level of an analog power voltage, the high power voltage terminal of the first amplifier may receive an analog power voltage, and the low power voltage terminal of the second amplifier may receive a ground voltage.

In an exemplary embodiment, the method may further include converting the image data of the horizontal line to the data voltage corresponding to the image data of the horizontal line using a gamma voltage, where the data voltage corresponding to the image data of the horizontal line may be applied to an input terminal of the first amplifier or an input terminal of the second amplifier.

According to exemplary embodiments of the invention, when the image data of the horizontal line satisfies the condition of the charging inferiority pattern, the data voltage of the horizontal line is compensated based on the over-driving or under-driving data voltage, and the output voltage range of the output buffering part is controlled to include the over-driving or under-driving data voltage. Thus, in such embodiments, an over-driving mode and an under driving mode for improving the charging ratio may be fully performed and the display quality may be improved. In such embodiments, when the image data of the horizontal line does not satisfy the condition of the charging inferiority pattern, the output voltage range of the output buffering part is controlled to a normal voltage range and thus, power consumption may be decreased.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
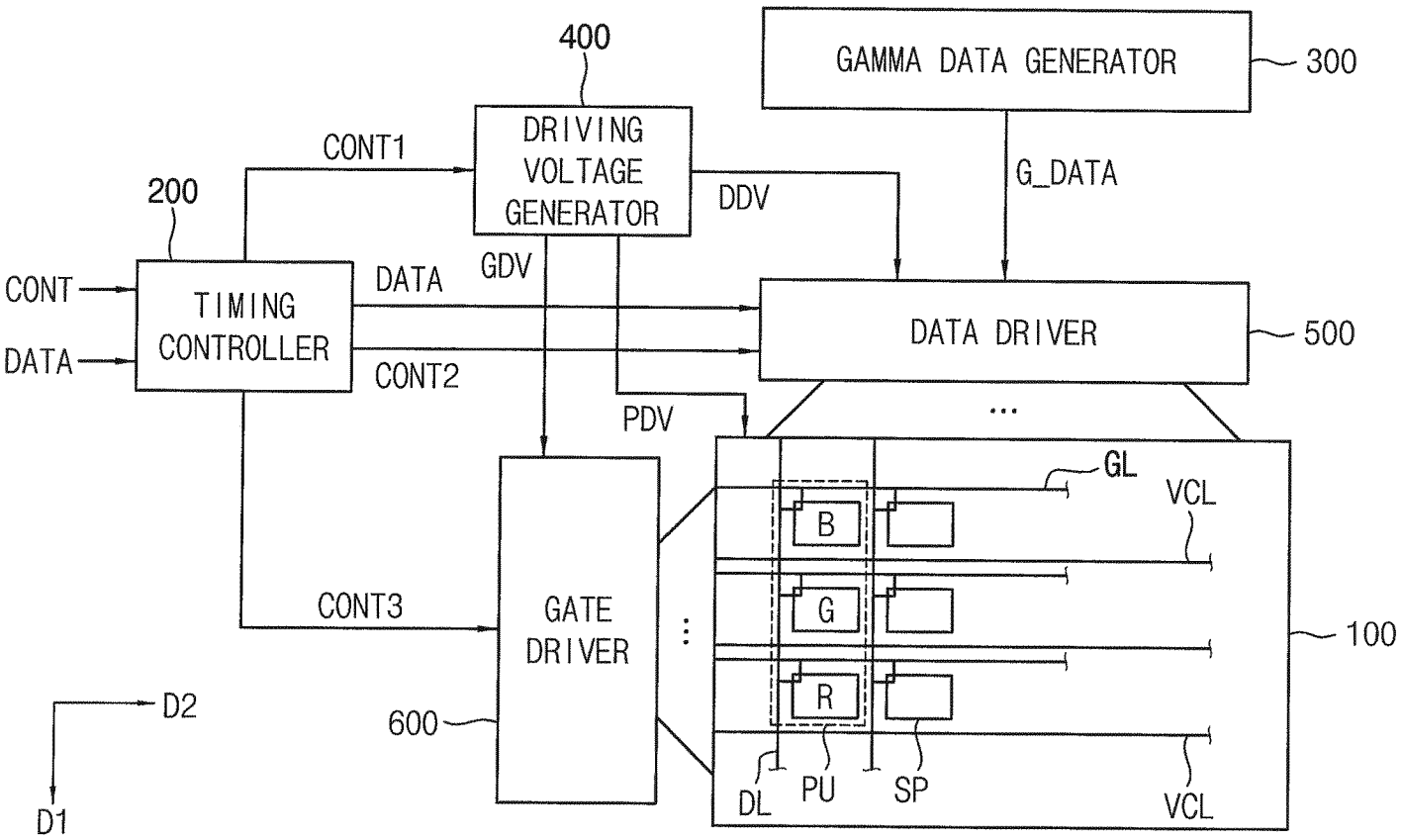
FIG. 1 is a block diagram illustrating a display device according to an exemplary embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, "as least one of A and B" means "A and/or B." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, exemplary embodiments of the invention will be described in detail with reference to the accompanying drawings.

FIG. 1 is a block diagram illustrating a display device according to an exemplary embodiment.

Referring to FIG. 1, an embodiment of the display device may include a display panel 100, a timing controller 200, a gamma data generator 300, a driving voltage generator 400, a data driver 500 and a gate driver 600.

The display panel 100 may include a plurality of data lines DL, a plurality of gate lines GL, a plurality of common voltage lines VCL and a plurality of pixel parts (or unit pixels) PU. The data lines DL extend in a first direction D1 and are arranged in the second direction D2 crossing the first direction D1. The gate lines GL extend in the second direction D2 and are arranged in the first direction D1. The common voltage lines VCL extend in the second direction D2 and are arranged in the first direction D1.

The pixel parts PU may be arranged substantially in a matrix form which includes a plurality of pixel rows and a plurality of pixel columns. Each of the pixel parts PU may include a plurality of sub pixels SP. In one exemplary embodiment, for example, a pixel part PU may include a red sub pixel R, a green sub pixel G and a blue sub pixel B.

Each sub pixel may include a switching transistor connected to a corresponding data line and a corresponding gate line, an LC capacitor connected to the switching transistor and a storage capacitor connected to the LC capacitor. The common voltage line VCL transfers a common voltage to a common electrode of the storage capacitor.

In an exemplary embodiment, each sub pixel, e.g., each of the red sub pixel R, the green sub pixel G and the blue sub pixel B, has a shorter side corresponding to the first direction D1 and a longer side corresponding to the second direction D2, and is connected to a same data line.

The timing controller 200 controls an operation of the display device. The timing controller 200 receives image data DATA and a control signal CONT from an external device.

The timing controller 200 may correct the image data DATA using at least one of various compensation algorithms.

The timing controller 200 generates a plurality of control signals for driving the display device based on the control signal CONT. The plurality of control signals may include a first control signal CONT1 for controlling the driving voltage generator 400, a second control signal CONT2 for controlling the data driver 500 and a third control signal CONT3 for controlling the gate driver 600.

According to an exemplary embodiment, the timing controller 200 may analyze image data by a horizontal line unit or for every horizontal line, and control the data driver 500 by every horizontal period based on an analysis result.

In one exemplary embodiment, for example, the timing controller 200 controls the data driver 500 to output a compensation data voltage for compensating s charging ratio of the pixels in the horizontal line when the image data of the horizontal line satisfies a condition of a charging inferiority pattern. In an exemplary embodiment, the compensation data voltage may include an over-driving data voltage having a level higher than the data voltage and an under-driving data voltage having a level lower than the data voltage.

The timing controller 200 extends an output voltage range of the data driver 500 to a preset output voltage range when the data driver 500 is driven for compensating the charging ratio. The preset output voltage range is larger than the output voltage range of a normal voltage range in which the data driver 500 is normally driven.

In an exemplary embodiment, the timing controller 200 controls the data driver 500 to output a data voltage corresponding to the image data of the pixels in the horizontal line when the image data of the horizontal line does not satisfy the condition of the charging inferiority pattern. The timing controller 200 maintains an output voltage range of the data driver 500 into the normal voltage range in which the data driver 500 is normally driven.

In an exemplary embodiment, the gamma data generator 300 generates gamma data using a symmetric gamma or an asymmetric gamma, and outputs the gamma data to the data driver 500. The gamma data may include positive polarity gamma data and negative polarity gamma data.

In such an embodiment, the symmetric gamma has positive polarity gamma data and negative polarity gamma data which are symmetric with respect to the common voltage according to a grayscale. The asymmetric gamma has positive polarity gamma data and negative polarity gamma data which are asymmetric with respect to the common voltage according to the grayscale. The common voltage may be applied to the common electrodes of the storage capacitor and the LC capacitor.

The driving voltage generator 400 generates a plurality of driving voltages for driving the display device using an external power voltage. The plurality of driving voltages may include a data driving voltage DDV applied to the data driver 500, a gate driving voltage GDV applied to the gate driver 600 and a panel driving voltage PDV applied to the display panel 100.

In an exemplary embodiment, the data driving voltage DDV may include a plurality of power voltages applied to an output buffering part, for example, an analog power voltage AVDD, a half power voltage HAVDD, a positive polarity half power voltage P_HAVDD and a negative polarity half power voltage N_HAVDD (shown in FIGS. 7A to 8C).

According to an exemplary embodiment, when the image data of the horizontal line satisfies the condition of the charging inferiority pattern, the driving voltage generator 400 may provide the output buffering part of the data driver 500 with the analog power voltage AVDD, the positive polarity half power voltage P_HAVDD and the negative polarity half power voltage N_HAVDD. In such an embodiment, when the image data of the horizontal line does not satisfy the condition of the charging inferiority pattern, the driving voltage generator 400 may provide the output buffering part of the data driver 500 with the analog power voltage AVDD and the half power voltage HAVDD.

According to an exemplary embodiment, the analog power voltage AVDD, the half power voltage HAVDD, the positive polarity half power voltage P_HAVDD and the negative polarity half power voltage N_HAVDD may have levels satisfying the following inequation: AVDD>N_HAVDD>HAVDD>P_HAVDD>GND. Here, GND denotes a ground voltage.

The gate driving voltage GDV may include a gate-on voltage and a gate-off voltage.

The panel driving voltage PDV may include a common voltage which is applied to the common electrodes of the LC capacitor and the storage capacitor.

The data driver 500 converts the image data of the horizontal line to the data voltage of the positive polarity or the negative polarity using the gamma data of the positive polarity or the negative polarity provided from the gamma data generator 300 based on a polarity inversion mode, and outputs the data voltage of the positive polarity or the negative polarity to the plurality of data lines DL.

In one exemplary embodiment, for example, when an over-driving signal ODS is received from the timing controller 200, the data driver 500 generates an over-driving data voltage by adding a preset voltage to the data voltage corresponding to the image data, and outputs the over-driving data voltage to the data line DL. When an under-driving signal UDS is received from the timing controller 200, the data driver 500 generates an under-driving data voltage by subtracting a preset voltage from the data voltage corresponding to the image data, and outputs the under-driving data voltage to the data line DL.

In such an embodiment, when the over-driving or under-driving signal ODS or UDS is not received from the timing controller 200, the data driver 500 normally generates the data voltage corresponding to the image data and outputs the data voltage to the data line DL.

The gate driver 600 generates a plurality of gate signals, and sequentially outputs the gate signals to the gate lines GL of the display panel 100, respectively. The gate driver 500 includes a plurality of transistors which is formed substantially simultaneously with the switching transistor via a same process.

Figure 2:
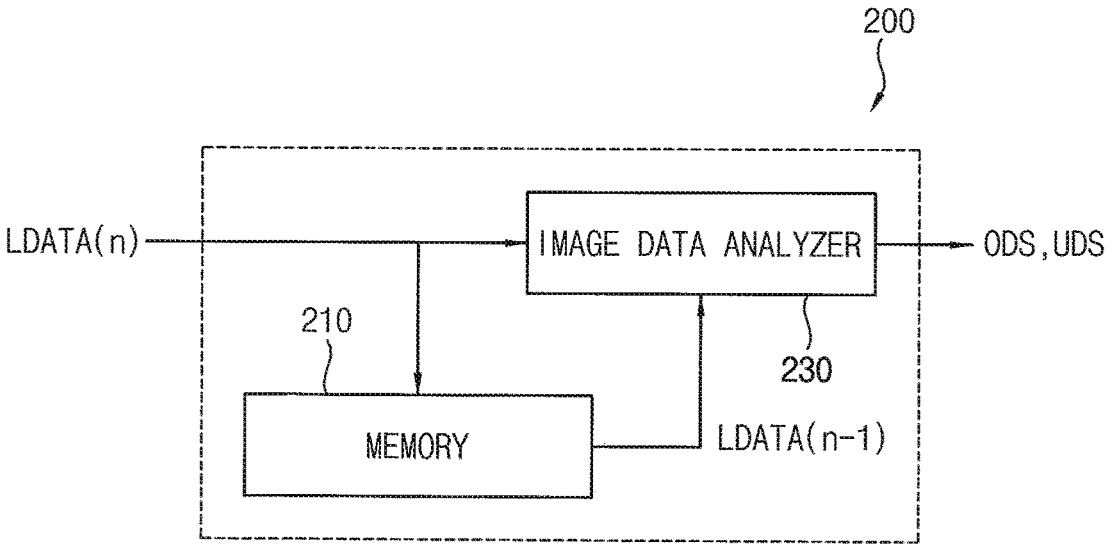
FIG. 2 is a block diagram illustrating a timing controller according to an exemplary embodiment.

FIG. 2 is a block diagram illustrating a timing controller according to an exemplary embodiment.

Referring to FIGS. 1 and 2, an exemplary embodiment of the timing controller 200 may include a memory 210 and an image data analyzer 230.

The memory 210 storages the image data. The memory 210 may be a frame memory using a dynamic capacitance compensation ("DCC") algorithm for improving a response time of the LC.

The image data analyzer 230 analyzes an image data LDATA(n) of an n-th horizontal line.

The image data analyzer 230 analyzes the image data LDATA(n) of a current horizontal line (i.e., the n-th horizontal line) and image data LDATA(n−1) of a pervious horizontal line, and determines whether the image data LDATA(n) of the current horizontal line satisfies the condition of the charging inferiority pattern.

In an exemplary embodiment, the image data analyzer 230 outputs an over-driving signal ODS or an under-driving signal UDS for controlling the data driver 500, when the image data LDATA(n) of the current horizontal line satisfies the condition of the charging inferiority pattern.

In one exemplary embodiment, for example, when a grayscale range of the image data is from about 0 grayscale to about 255 grayscale, a first reference value may be about 200 grayscale and a second reference value may be about 0 grayscale.

In an exemplary embodiment, when the image data LDATA(n−1) of the pervious horizontal line are equal to or more than the first reference value and the image data LDATA(n) of the current horizontal line are equal to or less than the second reference value, the image data analyzer 230 may output the under-driving signal UDS for compensating the charging ratio of the image data LDATA(n) of the current horizontal line.

In such an embodiment, when the image data LDATA(n−1) of the pervious horizontal line are equal to or less than the second reference value, and the image data LDATA(n) of the current horizontal line are equal to or more than the first reference value, the image data analyzer 230 may output the over-driving signal ODS for compensating the charging ratio of the image data LDATA(n) of the current horizontal line.

Figure 3:
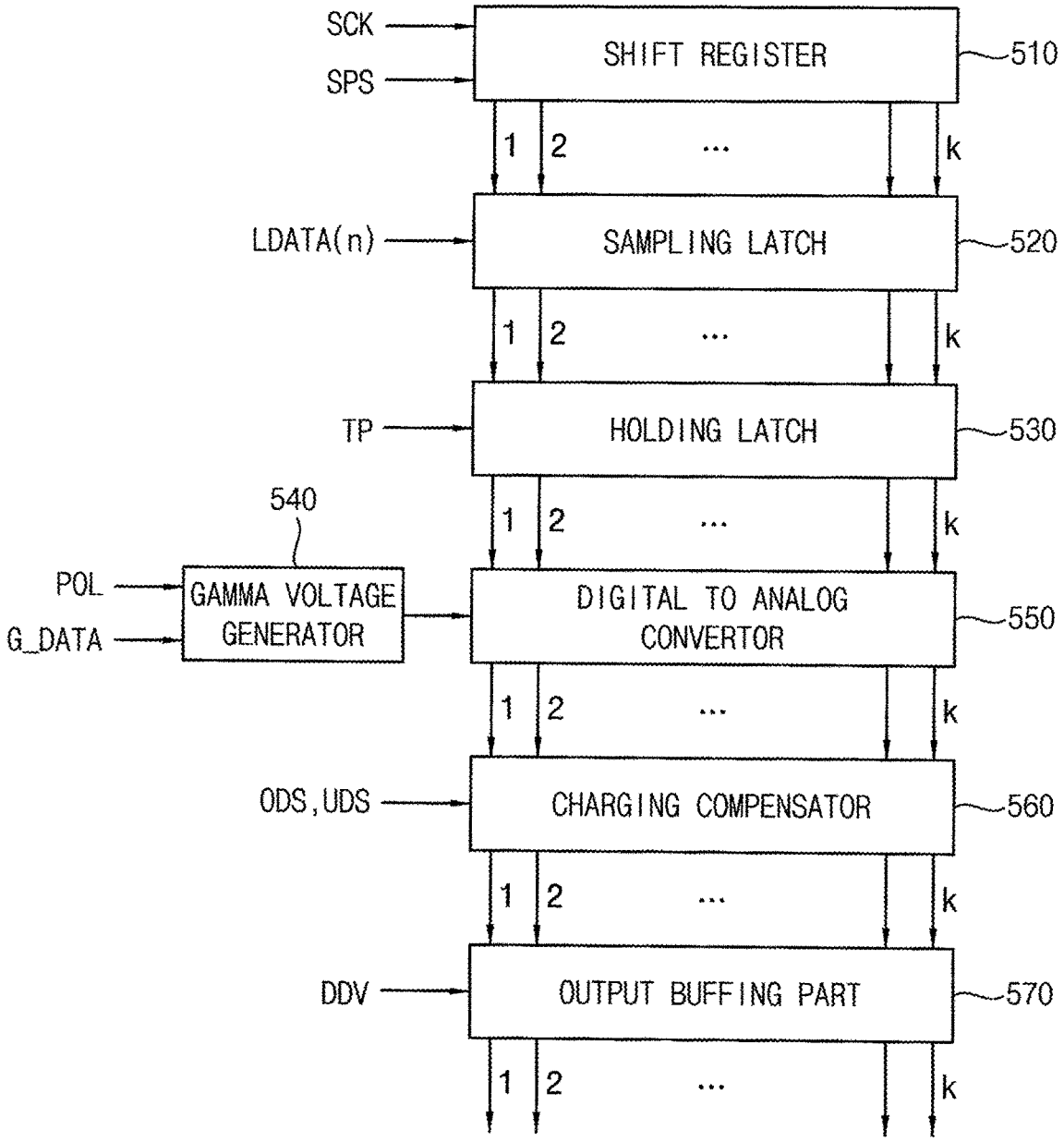
FIG. 3 is a block diagram illustrating a data driver according to an exemplary embodiment.

FIG. 3 is a block diagram illustrating a data driver according to an exemplary embodiment.

Referring to FIGS. 2 and 3, an exemplary embodiment of the data driver 500 includes a shift register 510, a sampling latch 520, a holding latch 530, a gamma voltage generator 540, a digital-to-analog convertor 550, a charging compensator 560 and an output buffering part 570. The data driver 500 may be formed as a single-chip.

The shift register 510 receives a shift clock signal SCK and a start pulse signal SPS from the timing controller, and generates k sampling signals by shifting the start pulse signal SPS by every one cycle of the shift clock signal SCK.

The sampling latch 520 sequentially stores k image data LDATA(n) corresponding to the horizontal line in response to the k sampling signals.

The holding latch 530 concurrently stores the k image data LDATA(n) and provides the digital-to-analog convertor 550 with the k image data in response to a load signal TP received from the timing controller.

The gamma voltage generator 540 generates positive polarity gamma voltages or negative polarity gamma voltages using a plurality of gamma data G_DATA received from the gamma data generator and a polarity control signal POL received from the timing controller. The positive polarity and negative polarity gamma voltages are applied to the digital-to-analog convertor 550.

The digital-to-analog convertor 550 converts the k image data to k positive polarity data voltages or k negative polarity data voltages using the polarity control signal POL received from the timing controller and the positive polarity or negative polarity gamma voltages received from the gamma voltage generator 540, and outputs the k positive polarity data voltages or the k negative polarity data voltages.

The charging compensator 560 compensates the k positive polarity data voltages or the k negative polarity data voltages into over-driving data voltages or under-driving data voltages based on the over-driving signal ODS or the under-driving signal UDS received from the timing controller. The over-driving data voltages are generated by respectively adding the preset voltage to the k positive polarity data voltages or the k negative polarity data voltages generated from the digital-to-analog convertor 550, and the under-driving data voltages are generated respectively subtracting the preset voltage from the k positive polarity data voltages or the k negative polarity data voltages generated from the digital-to-analog convertor 550.

When the over-driving signal ODS or the under-driving signal UDS is not received from the timing controller, the charging compensator 560 directly transfers the k positive polarity data voltages or the k negative polarity data voltages generated from the digital-to-analog convertor 550 to the output buffering part 570.

The output buffing part 570 amplifies the k positive polarity data voltages or the k negative polarity data voltages and outputs the amplified k positive polarity data voltages or the amplified k negative polarity data voltages to k data lines.

In an exemplary embodiment, when the charging compensator 560 is driven based on the over-driving and under-driving signals ODS and UDS, the output buffing part 570 receives the analog power voltage AVDD, the positive polarity half power voltage P_HAVDD and the negative polarity half power voltage N_HAVDD generated from the driving voltage generator based on an control of the timing controller.

In an exemplary embodiment, when the over-driving data voltage or the under-driving data voltage has the positive polarity, the output buffering part 570 amplifies the over-driving data voltage or the under-driving data voltage based on the analog power voltage AVDD and the positive polarity half power voltage P_HAVDD. In such an embodiment, when the over-driving data voltage or the under-driving data voltage has the negative polarity, the output buffering part 570 amplifies the over-driving data voltage or the under-driving data voltage based on the negative polarity half power voltage N_HAVDD and the ground voltage GND.

In such an embodiment, when the over-driving and under-driving signals ODS and UDS is not received, the charging compensator 560 is not driven. Thus, the output buffering part 570 receives the analog power voltage AVDD and half power voltage HAVDD generated from the driving voltage generator based on a control of the timing controller.

In an exemplary embodiment, when the data voltage generated from the digital-to-analog convertor 550 has the positive polarity, the output buffering part 570 amplifies the data voltage based on the analog power voltage AVDD and the half power voltage HAVDD. In such an embodiment, when the data voltage generated from the digital-to-analog convertor 550 has the negative polarity, the output buffering part 570 amplifies the data voltage based on the half power voltage HAVDD and ground voltage GND.

Figure 4:
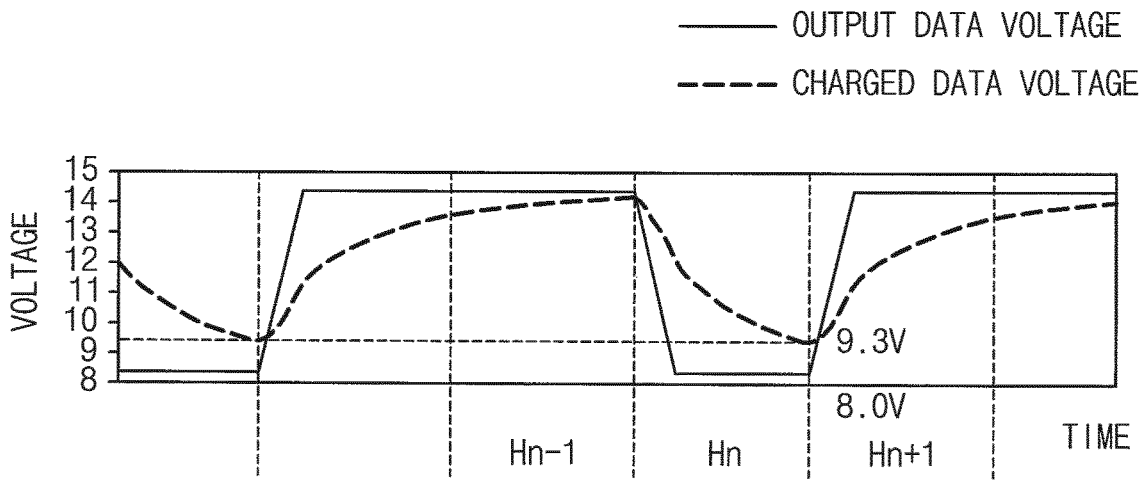
FIG. 4 is a waveform diagram illustrating a charging inferiority pattern according to an exemplary embodiment.
Figure 5:
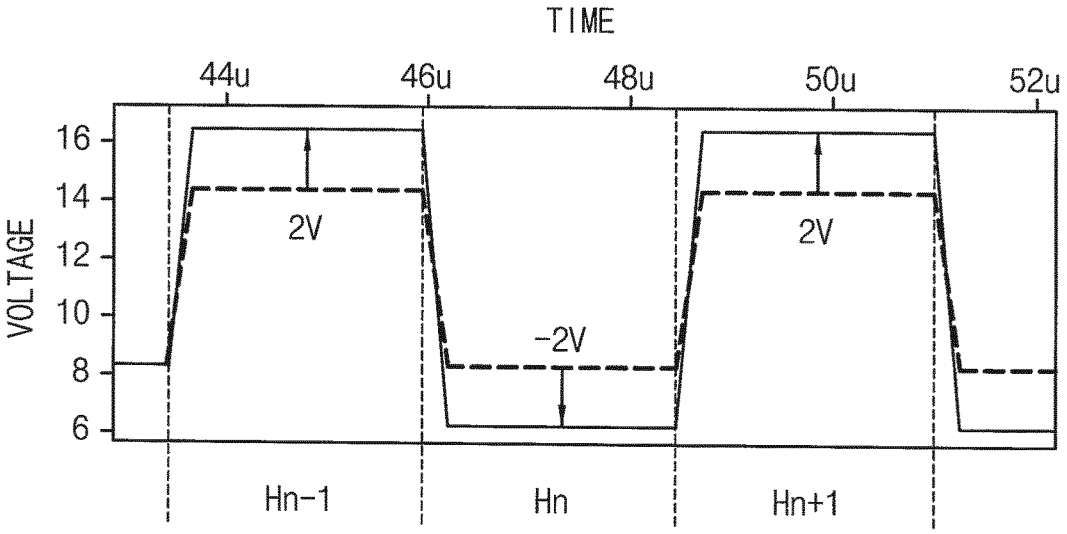
FIG. 5 is a waveform diagram illustrating methods of over-driving and under-driving data voltage according to an exemplary embodiment.

FIG. 4 is a waveform diagram illustrating a charging inferiority pattern according to an exemplary embodiment. FIG. 5 is a waveform diagram illustrating methods of over-driving and under-driving data voltage according to an exemplary embodiment.

Referring to FIG. 4, referring to the charging inferiority pattern, a charging time of a 1 horizontal period (1H) in which the data voltage is charged in the pixel is constant. Thus, the charged data voltage in the pixel is less than the data voltage outputted from the data driver. In one exemplary embodiment, for example, the charging inferiority pattern is included in a compound color image such as cyan, magenta, yellow, etc. in which change of the data voltage is big by every horizontal period.

In one exemplary embodiment, for example, an outputted data voltage of about 14.2 volts (V) corresponding to 224 grayscale data may be applied to a pixel in an (n−1)-th horizontal line Hn−1, and an outputted data voltage of about 8.0 V corresponding to 0 grayscale data may be applied to a pixel in an n-th horizontal line Hn, as shown in FIG. 4.

In such an embodiment, the pixel in the n-th horizontal line Hn charges the data voltage of about 9.3 V corresponding to 0 grayscale data. Thus, the pixel in the n-th horizontal line Hn charges the data voltage of about 9.3 V higher than the outputted data voltage of about 8.0 V.

In such an embodiment, as described above, the pixel in the n-th horizontal line Hn has a reduced charging time and thus, a difference voltage between the charged data voltage and the outputted data voltage of about 1 V may occur. Accordingly, display defects may occur due to the difference voltage.

Referring to FIG. 5, in an exemplary embodiment, an outputted data voltage of about 14.2 V corresponding to 224 grayscale data may be applied to a pixel in an (n−1)-th horizontal line Hn−1, an outputted data voltage of about 8.0 V corresponding to 0 grayscale data may be applied to a pixel in an n-th horizontal line Hn, and an outputted data voltage of about 14.2 V corresponding to 224 grayscale data may be applied to a pixel in an (n+1)-th horizontal line Hn+1.

According to an exemplary embodiment, the pixel of the (n−1)-th horizontal line Hn−1 has the 224 grayscale data being more than 200 grayscale data of a first reference value and the pixel of the n-th horizontal line Hn has 0 grayscale data the same as 0 grayscale data of a second reference value. Thus, the pixel of the n-th horizontal line Hn satisfies the condition of the charging inferiority pattern.

Therefore, in such an embodiment, the data driver outputs the under-driving data voltage of about 6.0 V to the pixel of the n-th horizontal line Hn. The under-driving data voltage of about 6.0 V is generated by subtracting a preset voltage of 2 V from the data voltage of 8.0 V corresponding to 0 grayscale image data. Thus, the pixel of the n-th horizontal line Hn may charge the data voltage of 8.0 V corresponding to 0 grayscale image data for the reduced charging time.

In an exemplary embodiment, the pixel of the n-th horizontal line Hn may have the 0 grayscale data the same as 0 grayscale data of a second reference value, and the pixel of the (n+1)-th horizontal line Hn+1 has 224 grayscale data being more than 200 grayscale data of a first reference value. Thus, in such an embodiment, the pixel of the n-th horizontal line Hn satisfies the condition of the charging inferiority pattern.

Therefore, the data driver outputs the over-driving data voltage of about 16.2 V to the pixel of the (n+1)-th horizontal line Hn+1. The over-driving data voltage of about 16.2 V is generated by adding a preset voltage of 2 V from the data voltage of 14.2 V corresponding to 224 grayscale image data. Thus, the pixel of the (n+1)-th horizontal line Hn+1 may charge the data voltage of 14.2 V corresponding to 224 grayscale image data for reduced charging time.

Figure 6:
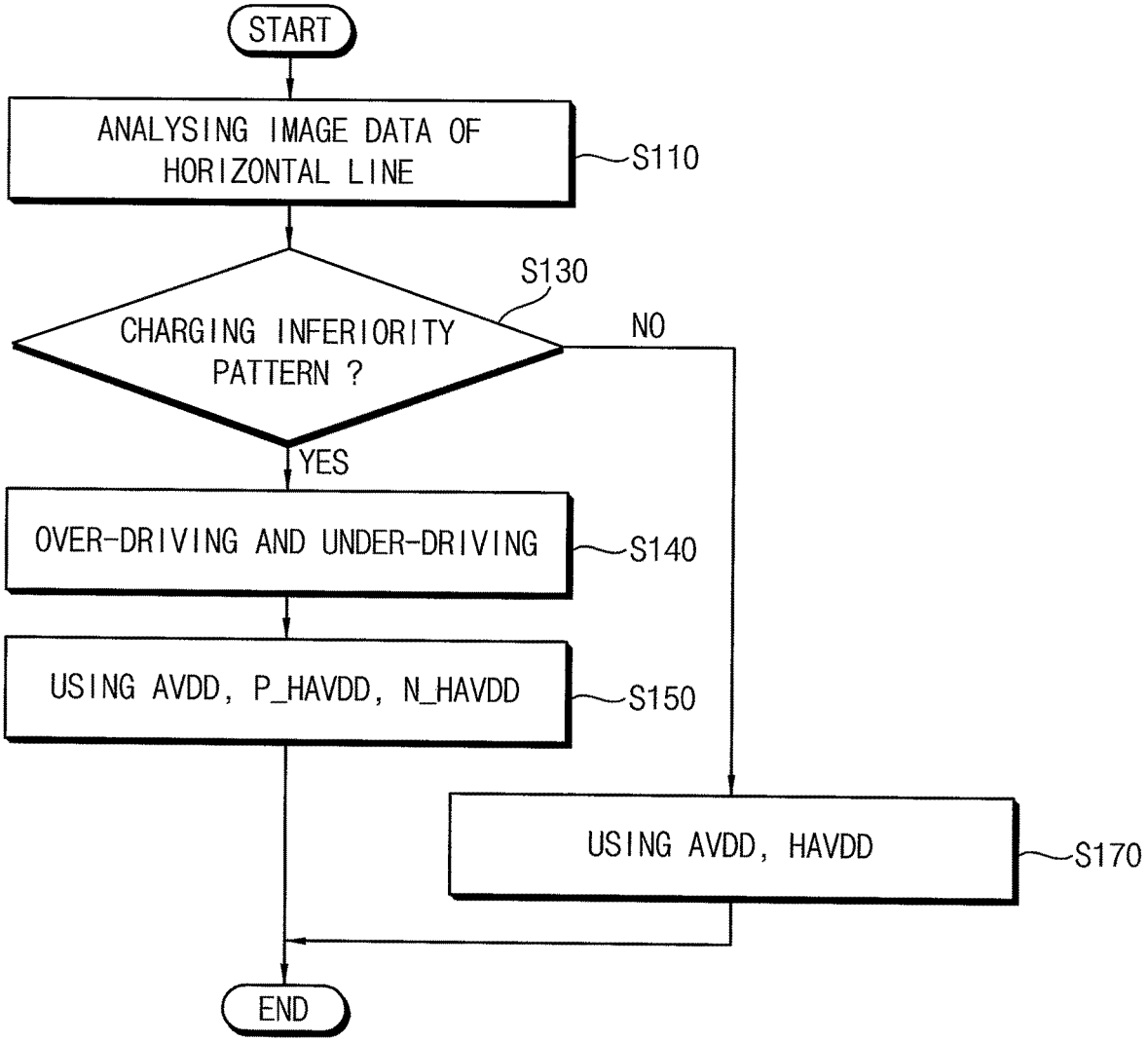
FIG. 6 is a flowchart diagram illustrating a method of driving the display device according to an exemplary embodiment.
Figure 7A:
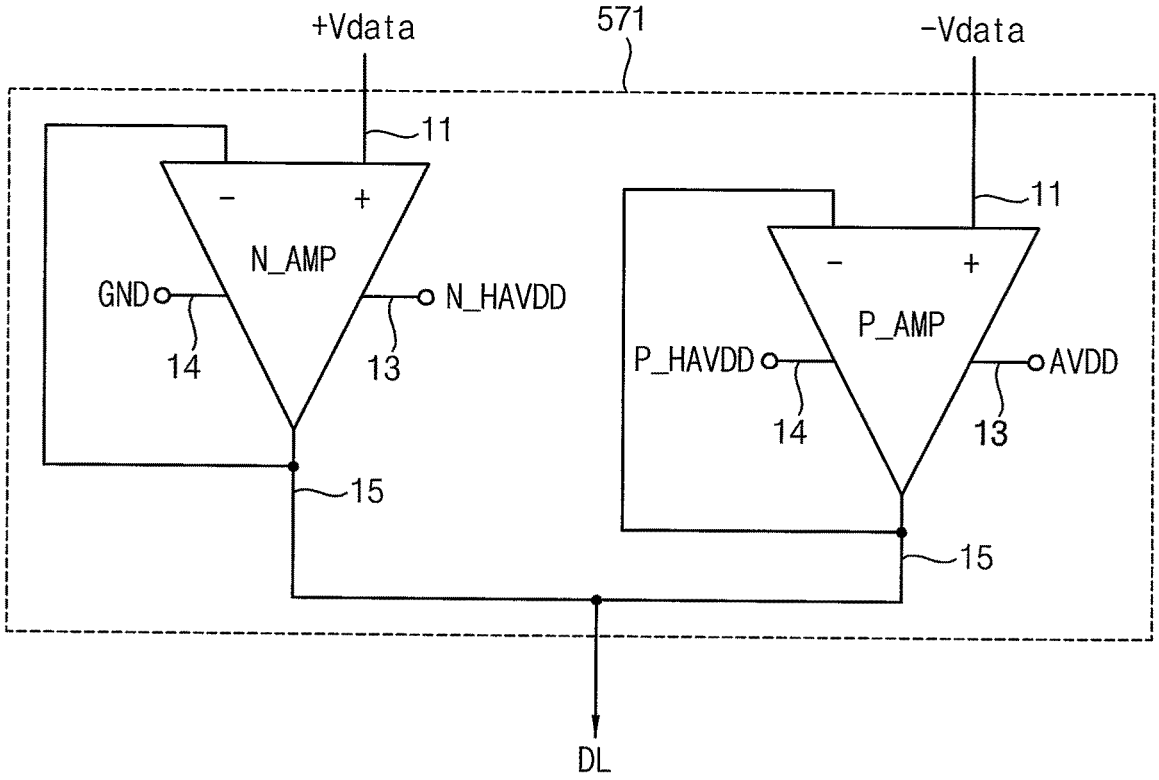
FIGS. 7A to 7C are conceptual diagrams illustrating a method of driving an output buffering part according to an exemplary embodiment.
Figure 7B:
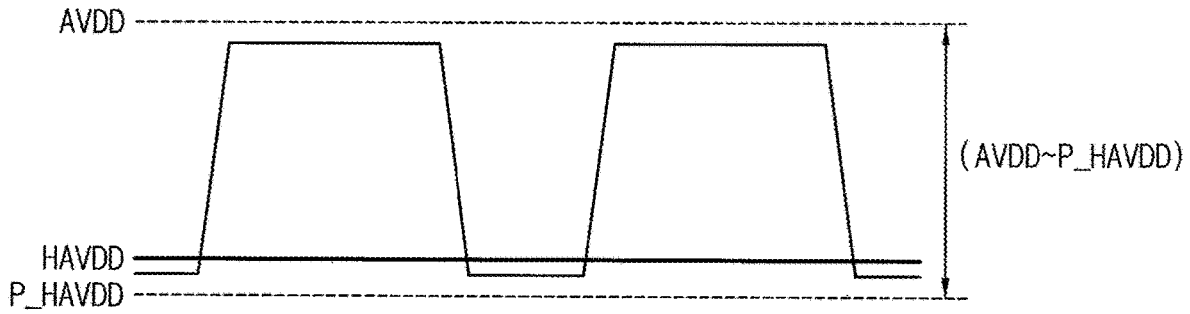
Figure 8A:
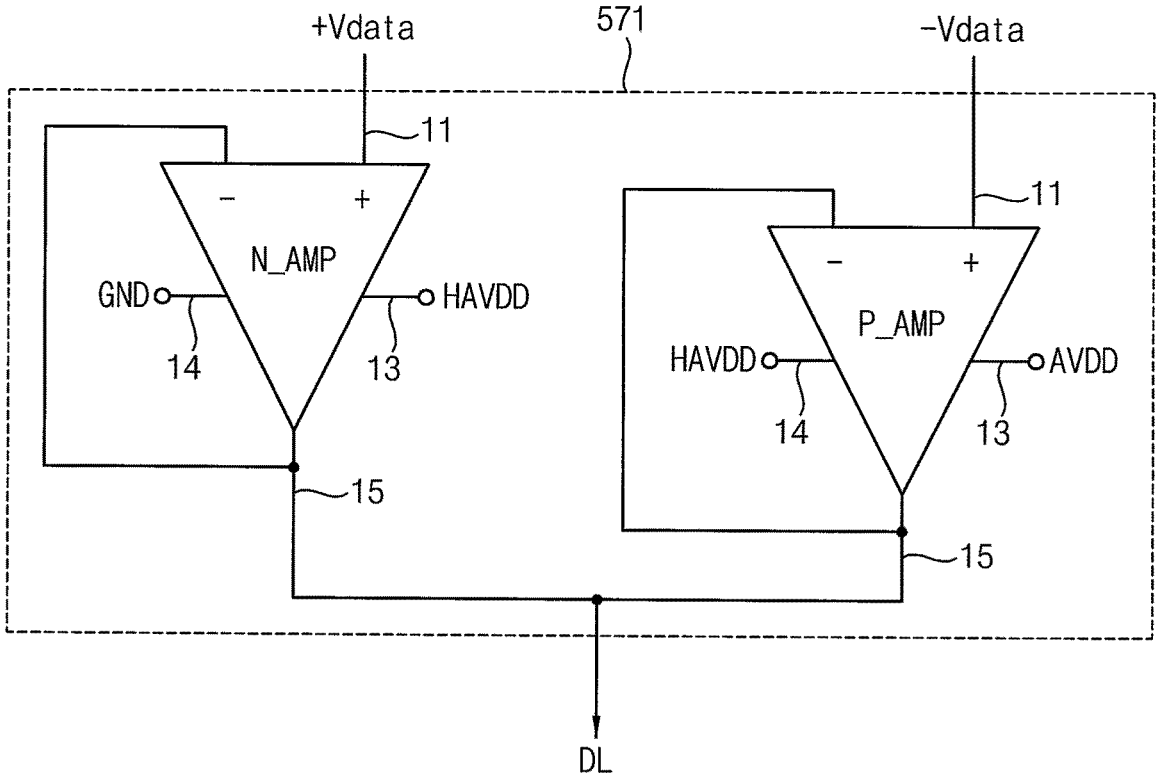
FIGS. 8A to 8C are conceptual diagrams illustrating a method of driving an output buffering part according to an exemplary embodiment.
Figure 8B:
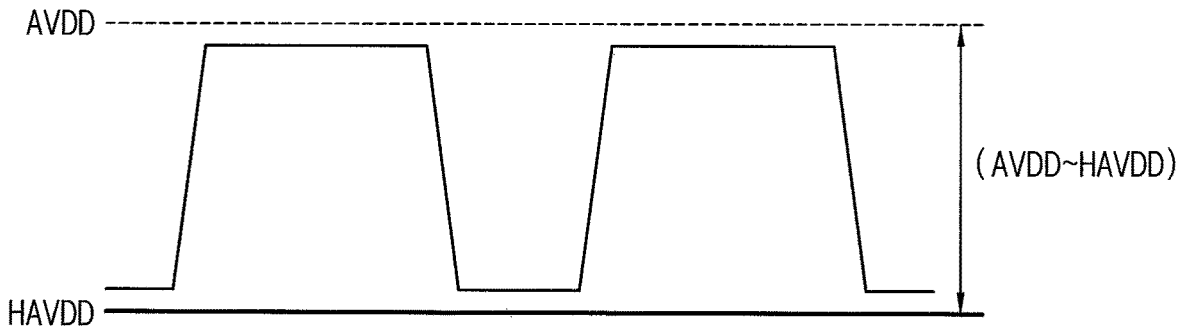

FIG. 6 is a flowchart diagram illustrating a method of driving the display device according to an exemplary embodiment. FIGS. 7A and 7B are conceptual diagrams illustrating a method of driving an output buffering part according to an exemplary embodiment. FIGS. 8A and 8B are conceptual diagrams illustrating a method of driving an output buffering part according to an exemplary embodiment.

Referring to FIGS. 2, 3 and 6, in an exemplary embodiment, image data LDATA(n) of a current horizontal line and image data LDATA(n−1) of a pervious horizontal line are analyzed and it is determined whether the image data LDATA(n) of the current horizontal line satisfies a condition of a charging inferiority pattern (S110). In one exemplary embodiment, for example, the image data analyzer 230 analyzes image data LDATA(n) of a current horizontal line and image data LDATA(n−1) of a pervious horizontal line and determines whether the image data LDATA(n) of the current horizontal line satisfies the condition of the charging inferiority pattern.

In such an embodiment, when the image data LDATA(n) of the current horizontal line satisfies the condition of the charging inferiority pattern, an over-driving signal ODS or an under-driving signal UDS is output (Step S130). In one exemplary embodiment, for example, the image data analyzer 230 outputs an over-driving signal ODS or an under-driving signal UDS for controlling the data driver 500 (S140), when the image data LDATA(n) of the current horizontal line satisfies the condition of the charging inferiority pattern.

In such an embodiment, the display device is driven using the analog power voltage AVDD, the positive polarity half power voltage P_HAVDD and the negative polarity half power voltage N_HAVDD (S150). In one exemplary embodiment, the output buffering part 570 receives the analog power voltage AVDD, the positive polarity half power voltage P_HAVDD and the negative polarity half power voltage N_HAVDD generated from the driving voltage generator based on a control of the timing controller.

In one exemplary embodiment, for example, referring to FIG. 7A, the output buffing part 570 includes k buffers 571. Each buffer 571 includes a first amplifier P_AMP which amplifies a positive polarity data voltage and a second amplifier N_AMP which amplifies a negative polarity data voltage.

Each of the first and second amplifiers P_AMP and N_AMP includes an input terminal 11 for receiving an input voltage, a first power voltage terminal 13 for receiving a high power voltage, a second power voltage terminal 14 for receiving a low power voltage and an output terminal 15 for outputting an output voltage.

In an exemplary embodiment, the buffer 571 receives the analog power voltage AVDD, the positive polarity half power voltage P_HAVDD and the negative polarity half power voltage N_HAVDD as the selected data driving voltage.

In an exemplary embodiment, for example, referring to the first amplifier P_AMP which amplifies the positive polarity voltage, the input terminal 11 thereof receives a positive polarity data voltage +Vdata, the first power voltage terminal 13 thereof receives the analog power voltage AVDD as the high power voltage, and the second power voltage terminal 14 thereof receives the positive polarity half power voltage P_HAVDD as the low power voltage.

Referring to the second amplifier N_AMP which amplifies the negative polarity, the input terminal 11 thereof receives a negative polarity data voltage of −Vdata, the first power voltage terminal 13 thereof receives the negative polarity half power voltage N_HAVDD as the high power voltage, and the second power voltage terminal 14 thereof receives the ground voltage GND as the low power voltage.

The analog power voltage AVDD, the positive polarity half power voltage P_HAVDD and the negative polarity half power voltage N_HAVDD may have voltage levels satisfying the following inequation: AVDD>N_HAVDD>P_HAVDD>GND.

Referring to FIG. 7B, the first amplifier P_AMP amplifies the over-driving data voltage and under-driving data voltage of the positive polarity in an output voltage range which is from the positive polarity half power voltage P_HAVDD to the analog power voltage AVDD.

Figure 7C:
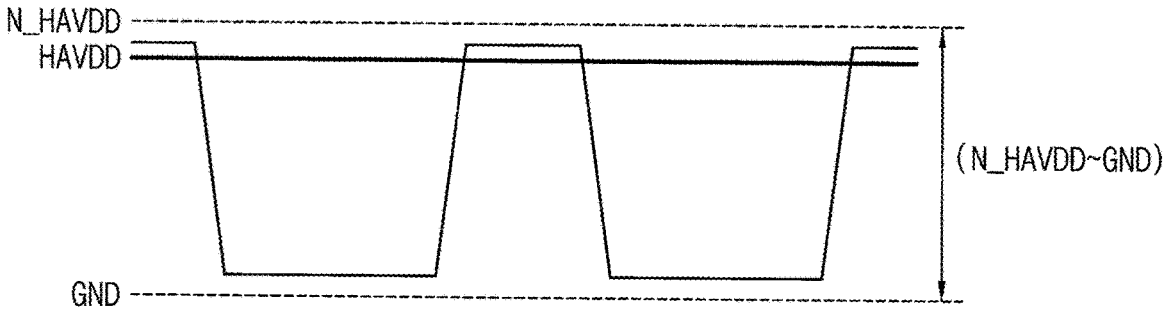

Referring to FIG. 7C, the second amplifier N_AMP amplifies the over-driving data voltage and under-driving data voltage of the negative polarity in an output voltage range which is from the ground voltage GND to the negative polarity half power voltage N_HAVDD.

The over-driving or under-driving data voltage amplified by the output buffing part 570 is outputted to the data line for every horizontal period.

In such an embodiment, when the image data LDATA(n) of the current horizontal line does not satisfy the condition of the charging inferiority pattern (S130), the display device is driven using the analog power voltage AVDD and the half power voltage HAVDD (S170). In one exemplary embodiment, the image data analyzer 230 does not output the over-driving signal ODS or the under-driving signal UDS for controlling the data driver 500, when the image data LDATA(n) of the current horizontal line does not satisfy the condition of the charging inferiority pattern.

Thus, the output buffing part 570 receives the analog power voltage AVDD and the half power voltage HAVDD generated from the driving voltage generator based on a control of the timing controller.

In one exemplary embodiment, for example, referring to FIG. 8A, the buffer 571 receives the analog power voltage AVDD and the half power voltage HAVDD.

In one exemplary embodiment, for example, referring to the first amplifier P_AMP which amplifies the positive polarity voltage, the input terminal 11 thereof receives a positive polarity data voltage +Vdata, the first power voltage terminal 13 thereof receives the analog power voltage AVDD as the high power voltage, and the second power voltage terminal 14 thereof receives the half power voltage HAVDD as the low power voltage.

Referring to the second amplifier N_AMP which amplifies the negative polarity, the input terminal 11 thereof receives a negative polarity data voltage of −Vdata, the first power voltage terminal 13 thereof receives the half power voltage HAVDD as the high power voltage and the second power voltage terminal 14 thereof receives the ground voltage GND as the low power voltage.

The half power voltage HAVDD may have a voltage level satisfying the following inequation: N_HAVDD>HAVDD>P_HAVDD.

Referring to FIG. 8B, the first amplifier P_AMP amplifies the data voltage of the positive polarity in an output voltage range which is from the half power voltage HAVDD to the analog power voltage AVDD.

Figure 8C:
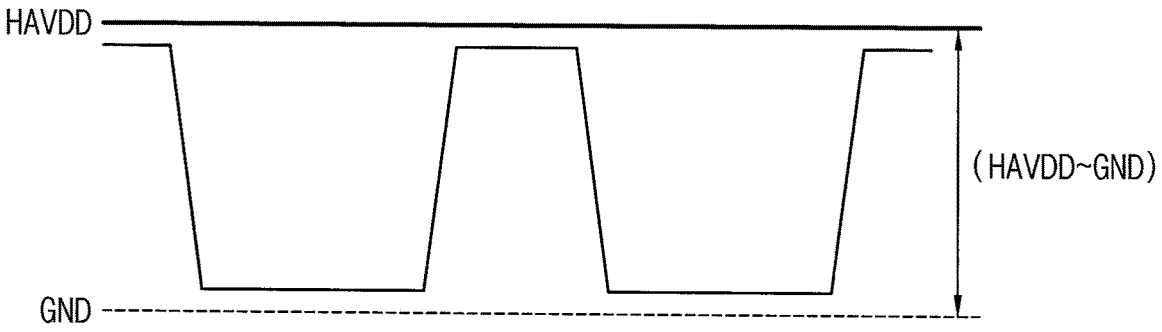

Referring to FIG. 8C, the second amplifier N_AMP amplifies the data voltage of the negative polarity in an output voltage range which is from the ground voltage GND to the half power voltage HAVDD.

The data voltage amplified the output buffing part 570 is outputted to the data line for every horizontal period.

Figure 9:
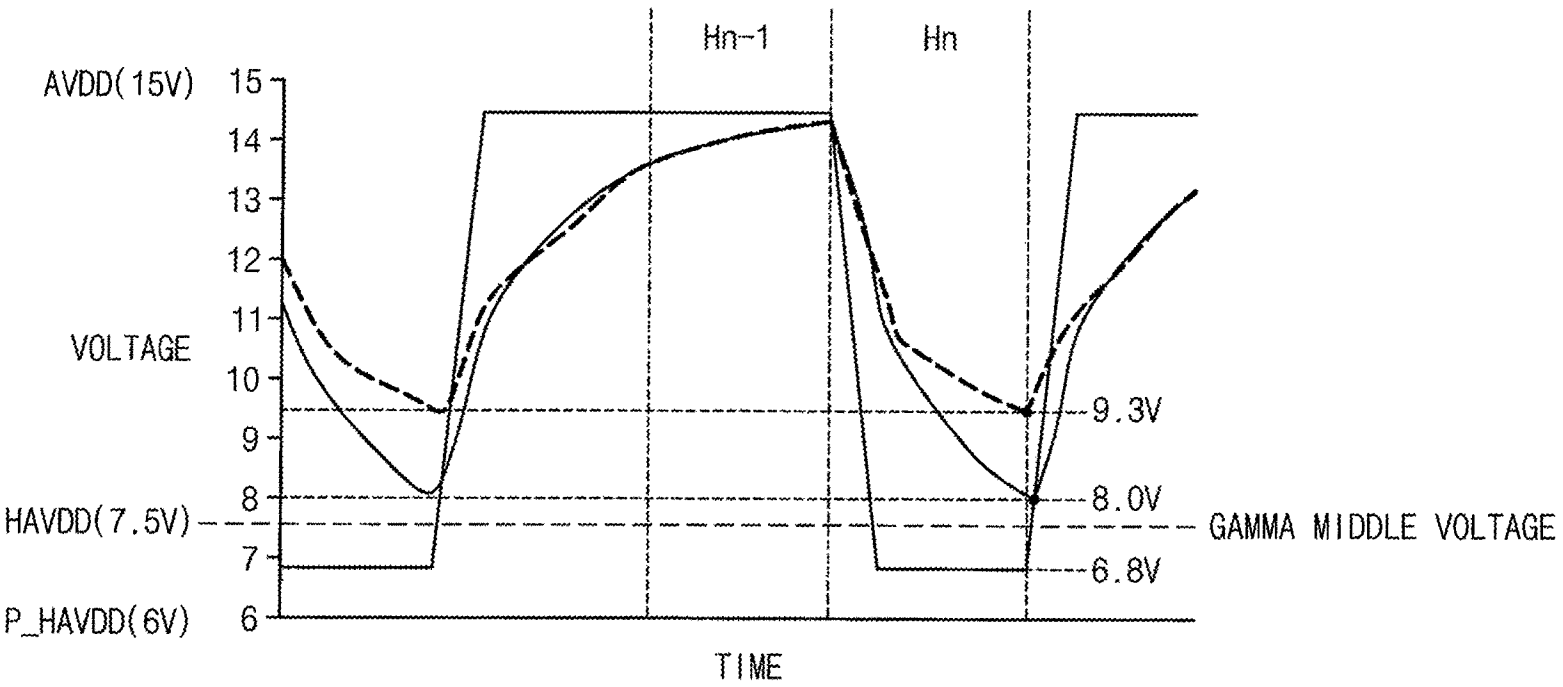
FIG. 9 is a waveform diagram illustrating a charged data voltage based on an output voltage range of an output buffering part according to a comparative exemplary embodiment and an exemplary embodiment.

FIG. 9 is a waveform diagram illustrating a charged data voltage based on an output voltage range of an output buffing part according to a comparative exemplary embodiment and an exemplary embodiment of the invention.

Referring to FIG. 9, the pixel of the (n−1)-th horizontal line Hn−1 has the 224 grayscale data being more than 200 grayscale data of a first reference value and the pixel of the n-th horizontal line Hn has 0 grayscale data the same as 0 grayscale data of a second reference value. Thus, the pixel of the n-th horizontal line Hn may satisfy the condition of the charging inferiority pattern.

Therefore, the data driver outputs the under-driving data voltage of about 6.8 V to the pixel of the n-th horizontal line Hn. The under-driving data voltage of about 6.8 V is generated by subtracting a preset voltage of 1.2 V from the data voltage of about 8.0 V corresponding to 0 grayscale image data.

According to a comparative exemplary embodiment, the output buffing part amplifies the under-driving data voltage of about 6.8 V of the positive polarity in the output voltage range which is from the half power voltage HAVDD of about 7.5 V to the analog power voltage AVDD of about 15 V.

The under-driving data voltage of about 6.8 V is out the output voltage range of the output buffing part. Thus, the output buffing part according to the comparative exemplary embodiment is limited in the under-driving mode.

According to the comparative exemplary embodiment, the pixel of the n-th horizontal line charges a pixel voltage of about 9.3 V.

However, according to an exemplary embodiment of the invention, the output buffing part amplifies the under-driving data voltage of about 6.8 V of the positive polarity in the output voltage range which is from the positive polarity half power voltage P_HAVDD of about 6 V to the analog power voltage AVDD of about 15 V.

The under-driving data voltage of about 6.8 V is in the output voltage range of the output buffing part. Thus, the output buffing part according to an exemplary embodiment of the invention is fully driven in an under-driving mode.

According to an exemplary embodiment, the pixel of the n-th horizontal line may charge a pixel voltage of about 8 V and thus, the under-driving mode may be performed with improved charging ratio.

According to exemplary embodiments, when the image data of the horizontal line satisfies the condition of the charging inferiority pattern, the data voltage of the horizontal line is compensated into the over-driving or under-driving data voltage, and the output voltage range of the output buffing part is controlled to include the over-driving or under-driving data voltage. Thus, an under-driving mode and an under driving mode for improving the charging ratio may be fully performed and the display quality may be improved.

In such embodiments, when the image data of the horizontal line does not satisfy the condition of the charging inferiority pattern, the output voltage range of the output buffing part is controlled to a normal voltage range and thus, power consumption may be decreased.

Such an embodiment to the invention may be applied to a display device and an electronic device including the display device. In one exemplary embodiment, for example, an electronic device including a display device may be a computer monitor, a laptop, a digital camera, a cellular phone, a smart phone, a smart pad, a television, a personal digital assistant ("PDA"), a portable multimedia player ("PMP"), a MP3 player, a navigation system, a game console, a video phone, etc.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display device comprising:

a display panel comprising a data line and a unit pixel including sub pixels having different colors from each other, wherein the sub pixels of the unit pixel are connected to a same data line;

an image data analyzer which determines whether image data of a horizontal line satisfies a condition of a charging inferiority pattern by analyzing the image data of a current horizontal line and image data of a previous horizontal line; and an output buffing part comprising:

a first amplifier which amplifies and outputs a data voltage of a positive polarity; and a second amplifier which amplifies and outputs a data voltage of a negative polarity, wherein a low power voltage terminal of the first amplifier and a high power voltage terminal of the second amplifier receive power voltages having different levels from each other, respectively, when the image data of the horizontal line satisfies a condition of a charging inferiority pattern.

2. The display device of claim 1, wherein a high power voltage terminal of the first amplifier receives an analog power voltage, and a low power voltage terminal of the second amplifier receives a ground voltage.

3. The display device of claim 2, wherein the low power voltage terminal of the first amplifier receives a positive polarity half power voltage which is lower than a half power voltage having a half level of the analog power voltage, and the high power voltage terminal of the second amplifier receives a negative polarity half power voltage which is higher than the half power voltage.

4. The display device of claim 1, further comprising:

a charging compensator which generates a compensation data voltage for compensating a charging ratio of a data voltage corresponding to the image data of the horizontal line, when the image data of the horizontal line satisfies the condition of the charging inferiority pattern.

5. The display device of claim 4, wherein the compensation data voltage includes an over-driving data voltage having a level higher than the data voltage corresponding to the image data of the horizontal line and an under-driving data voltage having a level lower than the data voltage corresponding to the image data of the horizontal line.

6. The display device of claim 5, wherein when image data of a pervious horizontal line of the horizontal line are equal to or greater than a first reference value and the image data of the horizontal line are equal to or less than a second reference value, the data voltage corresponding to the image data of the horizontal line is compensated based on the under-driving data voltage, and when the image data of the pervious horizontal line of the horizontal line are equal to or less than the second reference value and the image data of the horizontal line are equal to or greater than the first reference value, the data voltage corresponding to the image data of the horizontal line is compensated based on the over-driving data voltage.

7. The display device of claim 4, wherein the compensation data voltage is applied to the first amplifier or the second amplifier.

8. The display device of claim 1, wherein when the image data of the horizontal line does not satisfy the charging inferiority pattern, the low power voltage terminal of the first amplifier and the high power voltage terminal of the second amplifier receive power voltages of a same level, respectively.

9. The display device of claim 8, wherein the low power voltage terminal of the first amplifier and the high power voltage terminal of the second amplifier receives a half power voltage having a half level of an analog power voltage, the high power voltage terminal of the first amplifier receives the analog power voltage, and the low power voltage terminal of the second amplifier receives a ground voltage.

10. The display device of claim 9, further comprising:

a digital-to-analog convertor which converts the image data of the horizontal line to a data voltage corresponding to the image data of the horizontal line using a gamma voltage, wherein the data voltage corresponding to the image data of the horizontal line is applied to an input terminal of the first amplifier or an input terminal of the second amplifier.

11. A method of driving a display device which comprises a data line and a unit pixel including sub pixels having different colors and connected to a same data line, the method comprising:

determining whether image data of a horizontal line satisfies a condition of a charging inferiority pattern by analyzing the image data of a current horizontal line and image data of a previous horizontal line;

amplifying and outputting a data voltage of a positive polarity through a first amplifier;

amplifying and outputting a data voltage of a negative polarity through a second amplifier; and applying power voltages having different levels from each other to a low power voltage terminal of the first amplifier and a high power voltage terminal of the second amplifier, respectively, when the image data of the horizontal line satisfies the condition of the charging inferiority pattern.

12. The method of claim 11, further comprising:

applying an analog power voltage to a high power voltage terminal of the first amplifier; and applying a ground voltage to a low power voltage terminal of the second amplifier.

13. The method of claim 12, wherein the low power voltage terminal of the first amplifier receives a positive polarity half power voltage which is lower than a half power voltage having a half level of the analog power voltage, and the high power voltage terminal of the second amplifier receives a negative polarity half power voltage which is higher than the half power voltage.

14. The method of claim 11, further comprising:

generating a compensation data voltage for compensating a charging ratio of a data voltage corresponding to the image data of the horizontal line, when the image data of the horizontal line satisfies the condition of the charging inferiority pattern.

15. The method of claim 14, wherein the compensation data voltage includes an over-driving data voltage having a level higher than the data voltage corresponding to the image data of the horizontal line and an under-driving data voltage having a level lower than the data voltage corresponding to the image data of the horizontal line.

16. The method of claim 15, wherein when image data of a pervious horizontal line of the horizontal line are equal to or greater than a first reference value and the image data of the horizontal line are equal to or less than a second reference value, the data voltage corresponding to the image data of the horizontal line is compensated based on the under-driving data voltage, and when the image data of the pervious horizontal line of the horizontal line are equal to or less than the second reference value and the image data of the horizontal line are equal to or greater than the first reference value, the data voltage corresponding to the image data of the horizontal line is compensated based on the over-driving data voltage.

17. The method of claim 14, wherein the compensation data voltage is applied to the first amplifier or the second amplifier.

18. The method of claim 11, wherein when the image data of the horizontal line does not satisfy the charging inferiority pattern, the low power voltage terminal of the first amplifier and the high power voltage terminal of the second amplifier receive power voltages of a same level, respectively.

19. The method of claim 18, wherein the low power voltage terminal of the first amplifier and the high power voltage terminal of the second amplifier receives a half power voltage having a half level of an analog power voltage, the high power voltage terminal of the first amplifier receives the analog power voltage, and the low power voltage terminal of the second amplifier receives a ground voltage.

20. The method of claim 19, further comprising:

converting the image data of the horizontal line to a data voltage corresponding to the image data of the horizontal line using a gamma voltage, wherein the data voltage corresponding to the image data of the horizontal line is applied to an input terminal of the first amplifier or an input terminal of the second amplifier.

* * * * *